US007430771B2

(12) United States Patent
Heimbrock

(10) Patent No.: US 7,430,771 B2
(45) **Date of Patent: *Oct. 7, 2008**

(54) MOVABLE CONTROL PANEL FOR A PATIENT SUPPORT

(75) Inventor: Richard H. Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/695,802

(22) Filed: Apr. 3, 2007

(65) Prior Publication Data

US 2007/0192958 A1 Aug. 23, 2007

Related U.S. Application Data

(63) Continuation of application No. 11/040,272, filed on Jan. 21, 2005, now Pat. No. 7,200,882.

(60) Provisional application No. 60/538,341, filed on Jan. 22, 2004.

(51) Int. Cl.
*A47C 21/08* (2006.01)
*A61G 7/015* (2006.01)
*A61G 7/00* (2006.01)

(52) U.S. Cl. ..... 5/430; 5/600

(58) Field of Classification Search ..... 5/600, 5/618, 613, 425–430, 658
See application file for complete search history.

(56) References Cited

U.S. PATENT DOCUMENTS

| | | | |
|---|---|---|---|
| 421,656 | A | 2/1890 | Blanken |
| 993,119 | A | 5/1911 | Stannard |
| 1,938,635 | A | 12/1933 | North |
| 2,136,088 | A | 11/1938 | Stevens, Sr. |
| 2,587,291 | A | 2/1952 | Rochers |
| 2,644,173 | A | 7/1953 | James |
| 2,710,976 | A | 6/1955 | Martensen |
| 2,722,017 | A | 11/1955 | Burst et al. |
| 2,817,854 | A | 12/1957 | Pratt |
| 2,817,855 | A | 12/1957 | Pratt |
| 2,951,252 | A | 9/1960 | Roche |
| 3,018,492 | A | 1/1962 | Rosen |
| 3,021,534 | A | 2/1962 | Hausted |
| 3,055,020 | A | 9/1962 | Mann |
| 3,063,066 | A | 11/1962 | Peck et al. |
| 3,148,387 | A | 9/1964 | Sarnie, Jr. et al. |
| 3,220,024 | A | 11/1965 | Nelson |
| 3,249,387 | A | 5/1966 | Pivacek |
| 3,321,779 | A | 5/1967 | Kaufman et al. |
| 3,344,445 | A | 10/1967 | Crawford |
| 3,351,962 | A | 11/1967 | Dodrill et al. |
| 3,486,176 | A | 12/1969 | Murcott |

(Continued)

FOREIGN PATENT DOCUMENTS

| | | |
|---|---|---|
| EP | 0037063 | 10/1981 |

(Continued)

*Primary Examiner*—Alexander Grosz
(74) *Attorney, Agent, or Firm*—Barnes & Thornburg LLP

(57) ABSTRACT

A patient support including a siderail movable between a raised position and a lowered position relative to the patient support. A controller coupled to the sideail moves between a deployed position and a stored position in response to movement of the siderail between the raised position and the lowered position.

20 Claims, 12 Drawing Sheets

U.S. PATENT DOCUMENTS 3,585,659 A 6/1971 Burst et al.
3,593,350 A 7/1971 Knight et al.
3,619,824 A 11/1971 Doyle
3,624,847 A 12/1971 Murcott et al.
3,742,530 A 7/1973 Clark
3,823,428 A 7/1974 Whyte
3,851,345 A 12/1974 Benoit et al.
3,865,434 A 2/1975 Sully
3,877,090 A 4/1975 Schutz
3,905,591 A 9/1975 Schorr et al.
3,932,903 A 1/1976 Adams et al.
3,971,083 A 7/1976 Peterson
3,977,664 A 8/1976 Mitchell et al.
4,038,709 A 8/1977 Kerwit
4,183,015 A 1/1980 Drew et al.
4,186,456 A 2/1980 Huempfner
4,195,829 A 4/1980 Reser
4,214,326 A 7/1980 Spann
4,215,446 A 8/1980 Mahoney
4,232,415 A 11/1980 Webber
4,370,765 A 2/1983 Webber
4,437,704 A 3/1984 Hovsepians
4,439,880 A 4/1984 Koncelik et al.
D276,112 S 10/1984 Ferrell et al.
4,484,367 A 11/1984 Jenkins
4,523,745 A 6/1985 Killman et al.
4,607,402 A 8/1986 Pollard
4,612,679 A 9/1986 Mitchell
4,653,129 A 3/1987 Kuck et al.
4,654,903 A 4/1987 Chubb et al.
4,670,923 A 6/1987 Gabriel et al.
4,672,698 A 6/1987 Sands
4,676,687 A 6/1987 Koffler
4,680,790 A 7/1987 Packard et al.
4,704,750 A 11/1987 Wheelock
4,710,049 A 12/1987 Chang
4,710,992 A 12/1987 Falwell et al.
4,745,647 A 5/1988 Goodwin
4,747,171 A 5/1988 Einsele et al.
4,767,419 A 8/1988 Fattore
4,768,249 A 9/1988 Goodwin
4,783,864 A 11/1988 Turner
4,800,600 A 1/1989 Baum
4,827,545 A 5/1989 Arp
4,839,933 A 6/1989 Plewright et al.
4,872,228 A 10/1989 Bishop
4,873,734 A 10/1989 Pollard
4,985,946 A 1/1991 Foster et al.
4,993,089 A 2/1991 Solomon et al.
5,010,611 A 4/1991 Mallett
5,035,014 A 7/1991 Blanchard
5,044,025 A 9/1991 Hunsinger et al.
5,077,843 A 1/1992 Dale et al.
5,083,332 A 1/1992 Foster et al.
5,083,334 A 1/1992 Huck et al.
5,084,925 A 2/1992 Cook
5,097,550 A 3/1992 Marra, Jr.
5,129,117 A 7/1992 Celestina et al.
5,175,897 A 1/1993 Marra, Jr.
5,179,744 A 1/1993 Foster et al.
5,191,663 A 3/1993 Holder et al.
D336,577 S 6/1993 Celestina et al.
5,216,768 A 6/1993 Bodine et al.
5,222,132 A 6/1993 Rioux, Jr.
5,235,258 A 8/1993 Schuerch
5,255,403 A 10/1993 Ortiz
5,279,010 A * 1/1994 Ferrand et al. ..... 5/600
5,345,629 A 9/1994 Ferrand
5,381,571 A 1/1995 Gabhart
5,384,927 A 1/1995 Mardero et al.
5,410,765 A 5/1995 Youngblood
5,418,988 A 5/1995 Iura
5,421,046 A 6/1995 Vande Streek
5,450,641 A 9/1995 Montgomery
5,455,973 A 10/1995 Brumfield et al.
5,469,591 A 11/1995 Nomura
5,481,772 A 1/1996 Glynn et al.
5,485,699 A 1/1996 Gabhart
5,524,306 A 6/1996 George
5,537,701 A 7/1996 Elliott
5,542,136 A * 8/1996 Tappel ..... 5/710
5,557,817 A 9/1996 Haddock
5,577,277 A 11/1996 Sundberg et al.
5,642,545 A 7/1997 Howard
5,671,490 A 9/1997 Wu
5,678,267 A 10/1997 Kinder
5,689,839 A 11/1997 Laganiere et al.
5,700,053 A 12/1997 Downing
5,715,548 A 2/1998 Weismiller et al.
5,732,423 A * 3/1998 Weismiller et al. ..... 5/425
5,737,781 A 4/1998 Votel
5,749,112 A 5/1998 Metzler
5,761,756 A 6/1998 Nowak et al.
5,771,506 A 6/1998 Joiner
5,781,945 A 7/1998 Scherer et al.
5,802,636 A 9/1998 Corbin et al.
5,802,640 A 9/1998 Ferrand et al.
5,832,549 A 11/1998 Le Pallec et al.
5,864,900 A 2/1999 Landau
5,878,452 A 3/1999 Brooke et al.
5,890,244 A 4/1999 Cartwright et al.
5,906,016 A 5/1999 Ferrand et al.
5,906,017 A 5/1999 Ferrand et al.
5,926,873 A 7/1999 Fountain
5,934,754 A 8/1999 Raffa
6,008,598 A 12/1999 Luff et al.
6,038,721 A 3/2000 Gordon
6,058,531 A 5/2000 Carroll
6,163,903 A 12/2000 Weismiller et al.
6,182,310 B1 2/2001 Weismiller et al.
6,185,767 B1 * 2/2001 Brooke et al. ..... 5/600
6,208,250 B1 3/2001 Dixon et al.
6,320,510 B2 11/2001 Menkedick et al.
6,336,235 B1 1/2002 Ruehl
6,347,422 B2 2/2002 Heavrin
6,363,552 B1 4/2002 Hornbach et al.
6,397,416 B2 6/2002 Brooke et al.
6,401,281 B1 6/2002 Younge
6,438,776 B2 8/2002 Ferrand et al.
6,473,921 B2 11/2002 Brooke et al.
6,481,688 B1 11/2002 Welling et al.
6,486,792 B1 11/2002 Moster et al.
6,560,798 B2 5/2003 Welling et al.
6,611,979 B2 9/2003 Welling et al.
6,658,680 B2 * 12/2003 Osborne et al. ..... 5/600
6,668,408 B2 12/2003 Ferrand et al.
6,691,346 B2 2/2004 Osborne et al.
6,728,985 B2 5/2004 Brooke et al.
6,779,209 B2 8/2004 Ganance
6,791,460 B2 9/2004 Dixon et al.
6,829,793 B2 12/2004 Brooke et al.
2002/0059679 A1 5/2002 Weismiller et al.
2003/0009952 A1 1/2003 Gallant et al.
2006/0015911 A1 1/2006 Dean
2006/0165247 A1 7/2006 Mansfield et al.
2006/0198528 A1 9/2006 Tuffy et al.
2007/0022464 A1 1/2007 Dean

FOREIGN PATENT DOCUMENTS

GB 2136280 9/1984
WO 9817153 4/1998
WO 0069386 11/2000

* cited by examiner

MOVABLE CONTROL PANEL FOR A PATIENT SUPPORT

RELATED APPLICATIONS

This application is a continuation of application Ser. No. 11/040,272; now U.S. Pat. No. 7,200,882, filed Jan. 21, 2005, which claims the benefit of U.S. Provisional Patent Application Ser. No. 60/538,341, filed Jan. 22, 2004, the disclosures of which are expressly incorporated herein by this reference.

FIELD OF THE INVENTION

The present device generally relates to a control for a patient support (such as a hospital bed), and more particularly to a controller connected to the patient support such that movement of a support structure of the patient support (for example, a siderail) between a raised position and a lowered position relative to the patient support causes movement of the controller between a deployed position and a stored position, respectively.

BACKGROUND AND SUMMARY

It is known to provide a controller for a patient support, such as a hospital bed, to enable a user to perform a variety of functions including adjusting the bed configuration by, for example, raising or lowering the bed, tilting the bed, or raising, lowering, and/or tilting a portion of the bed relative to another portion of the bed. Conventional controllers are either built into the siderail of the bed, or are provided as pendants that may be stored in the siderail and removed from the siderail for use. Built in controllers generally provide an input surface having individual control switches for the various adjustment functions. The input surface is typically planar with a side surface of the siderail, facing the patient in the bed. This is a very poor ergonomic position. The severe angle between the patient and the controller makes the control switches on the input surface very difficult to see. Also, such controllers are very difficult to use since the patient must either reach across his or her body to access a controller built into one siderail, or bend his or her arm and wrist in an awkward angle to access a controller built into the other siderail.

Pendant controllers also have many disadvantages. While pendant controllers may be handheld, avoiding some of the ergonomic problems of built in controllers, pendant controllers may be stolen, lost, misplaced, dropped to the floor or otherwise rendered difficult or impossible to access by a patient in the bed. Moreover, pendant controllers may be damaged when dropped. Even pendant controllers that are tethered to the bed by a tether or an electrical cord may be located outside of an area that is conveniently accessible by the patient. For example, a tethered pendant controller may be located within the bed coverings or over the side of the bed, dangling from the tether. Indeed, tethered pendant controllers are further disadvantageous in that they present a choking hazard. Moreover, tethered pendant controllers are relatively difficult to clean, thereby presenting other health hazards.

In one embodiment of the device described herein, a controller for a bed is connected to a siderail of the bed so that movement of the siderail to a raised position causes movement of the controller to a deployed position which is ergonomically accessible by the patient. Additionally, movement of the siderail to a lowered position causes movement of the controller to a stored position.

In another embodiment, there is provided a controller for use with a patient support including a siderail having a lowered position and a raised position. The controller includes a housing having at least one selector to select a controllable function and a linkage mechanism coupled to the housing. The linkage mechanism is adapted to respond to movement of the siderail from the lowered position to the raised position and to correspondingly move the housing from a stored position to a deployed position spaced from the stored position.

In a further embodiment, there is provided a control device for use with a patient support including a siderail having at least two positions. The control device includes a linkage mechanism, having a first position associated with one of the at least two positions and a second position associated with another of the at least two positions. A housing is coupled to the linkage mechanism wherein the first position of the linkage mechanism locates the housing at a storage position and the second position of the linkage mechanism locates the housing at a deployed position. A release enables movement of the controller from the deployed position to the storage position when the siderail is in one of the at least two positions.

These and other features of the device will become apparent and be further understood upon reading the detailed description provided below with reference to the following drawings.

DETAILED DESCRIPTION OF EXEMPLARY EMBODIMENTS

Figure 1:
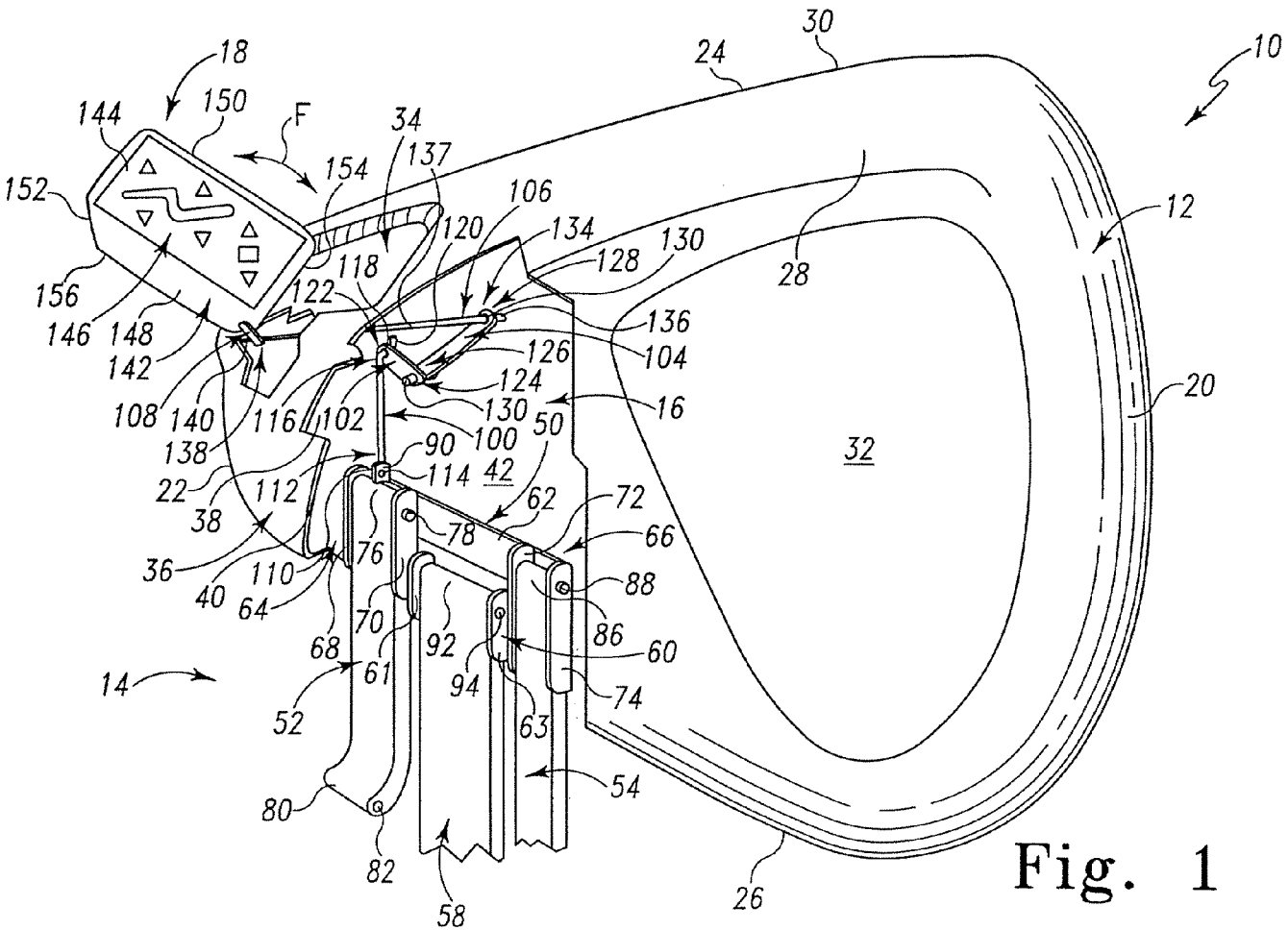
FIG. 1 is a partially fragmented, perspective view of one embodiment of a controller with a siderail in the raised position.

While the present device is susceptible to various modifications and alternative forms, exemplary embodiments thereof have been shown by way of example in the drawings and will herein be described in detail. It should be understood, however, that there is no intent to limit the device to the particular forms disclosed, but on the contrary, the intention is to address all modifications, equivalents, and alternatives falling within the spirit and scope of this disclosure as defined by the appended claims.

Referring now to FIG. 1, an embodiment of a control panel of the present invention, generally referred to by the numeral 10, includes a controller 18 coupled to a support structure of a patient support (not shown) by a linkage mechanism 16. In one application, the support structure is a siderail 12, which in turn is coupled to a hospital bed (not shown) by a linkage assembly 14. The siderail is generally coupled to the head end of the bed, so as to be adjacent to the patient's head, upper body, or torso, but may also be coupled to the foot end or other portion of the bed. Other applications, however, are within the scope of this disclosure. For example, controller 18 may be coupled to an overbed table or a table or other structure positioned adjacent to a bed, or to a handle or an armrest of a wheel chair.

The construction of hospital bed siderails is known. See, for example, U.S. Pat. Nos. 6,363,552, 6,640,360, and 6,622,323, which are owned by the assignee of the present application, incorporated herein by this reference. Siderail 12 may be formed in a conventional shape, and out of conventional materials. Siderail 12 includes a head end 20, positioned adjacent a head or upper torso of a patient when siderail 12 is connected to a hospital bed, a foot end 22, positioned nearer to the feet of the patient than head end 20, a top side 24, a bottom side 26, a mattress side 28 which faces a mattress (not shown) of the bed, and a caregiver side 30 which faces away from the mattress. Siderail 12 may define an opening 32 as shown in FIG. 1 and found in conventional siderails. Adjacent foot end 22, siderail 12 may define a recess 34 shaped to receive controller 18, as will be described in greater detail below. Siderail 12 may be formed such that it has an outer shell 36 that defines an interior space 38. As such, siderail 12 may include an inner wall 40 and an outer wall 42.

Figure 2B:
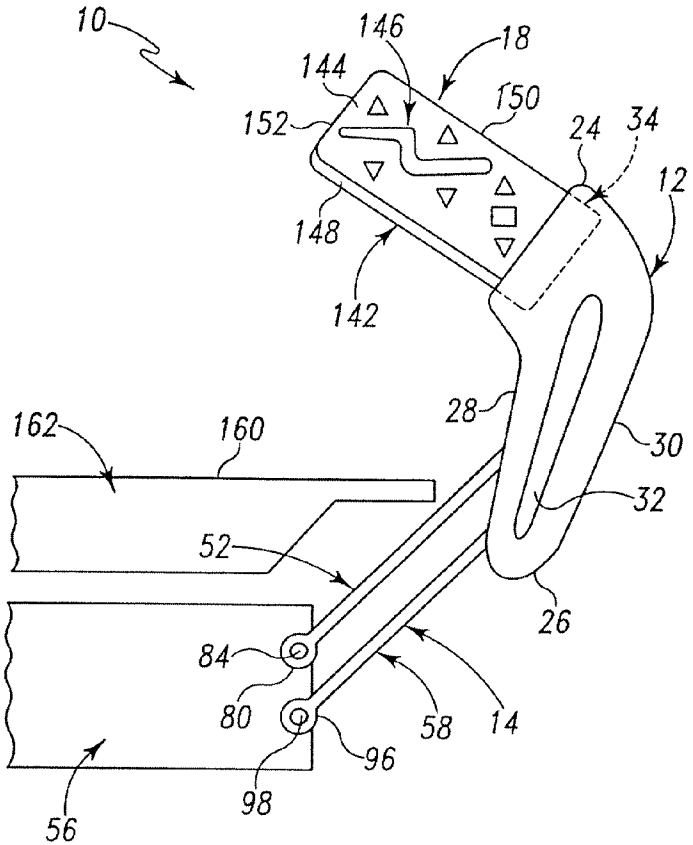
FIG. 2B is a partially fragmented, side elevation view of the embodiment of FIG. 1 with the siderail in the raised position.
Figure 2A:
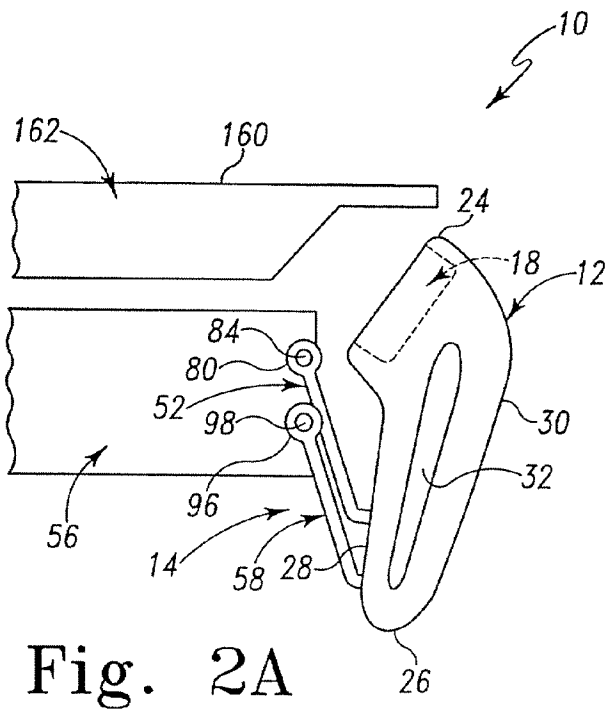
FIG. 2A is a partially fragmented, side elevation view of the embodiment of FIG. 1 with the siderail in the lowered position.

Linkage assembly 14 may be similar to the linkage assembly described in U.S. patent application publication number U.S. 2002/0066142 ("the '142 publication), owned by the assignee of the present application, the entire disclosure of which is incorporated herein by this reference. As shown in FIGS. 1 and 2A-B, such a linkage assembly 14 includes an upper link 50 that may be connected to outer wall 42 of siderail 12, a pair of siderail articulation arms 52, 54 that extend between upper link 50 and a bed frame 56, such as the intermediate frame of a hospital bed. Linkage assembly 14 further includes a center arm 58 that extends between frame 56 and a bracket 60 connected to outer wall 42. Bracket 60 includes a pair of flanges 61, 63 that extend substantially perpendicularly outward from outer wall 42. Upper link 50 may include a central portion 62 and a pair of end portions 64, 66. End portion 64 includes a pair of flanges 68, 70 that extend substantially perpendicularly outward from outer wall 42. Similarly, end portion 66 includes a pair of flanges 72, 74 that extend substantially perpendicularly outward from outer wall 42.

Arm 52 of linkage assembly 14 includes a first end 76 having an opening (not shown) sized to receive a rod 78. Rod 78 extends through first end 76 and between flanges 68, 70. Thus, arm 52 can pivot about rod 78 relative to flanges 68, 70. Arm 52 further includes a second end 80 having an opening 82. A second rod 84 (FIGS. 2A-B) extends through opening 82 to permit pivotal movement of second end 80 relative to frame 56. Arm 54 is substantially identical to arm 52. Therefore, the components of arm 54 shown in the figures use the same reference designations as the components of arm 52, but increased by 10. Arm 52 also includes a projection 90, which may be part of linkage mechanism 16 as is further described below.

Center arm 58 similarly includes a first end 92 having an opening (not shown) sized to receive a rod 94, and a second end 96 having an opening (not shown) sized to receive a rod 98. Rod 94 extends through first end 92 and between flanges 61, 63 so that first end 92 is pivotable about rod 92 relative to bracket 60. Rod 98 likewise extends through second end 96 of center arm 58 and is coupled to frame 56 to permit pivotal movement of second end 96 relative to frame 56.

In the embodiment of FIG. 1, linkage mechanism 16 generally includes projection 90 connected to first end 76 of arm 52, a first link 100, a second link 102, a third link 104, a fourth link 106, and an arm 108 connected to controller 18 as is further described below. Projection 90 is rigidly connected to first end 76 of arm 52, and extends therefrom in substantially parallel relationship to outer wall 42 when siderail 12 is in the raised position as shown in FIG. 1. Projection 90 includes an opening 110 for receiving a portion of first link 100. First link 100 includes a first end 112 that extends through opening 110 of projection 90, and provides a retainer portion 114 that curves relative to a longitudinal axis of first link 100 to retain first end 112 in opening 110 during actuation of linkage mechanism 16 as is further described below. First link 100 further includes a second end 116 that extends through an opening 118 of second link 102. Second end 116 similarly provides a retainer portion 120 that curves relative to the longitudinal axis of first link 100 to retain second end 116 in opening 118 during actuation of linkage mechanism 16. It should be understood, however, that either or both of retainer portions 114, 120, as well as openings 110, 118, may be replaced with any of a variety of different types of conventional movable connections.

As shown in FIG. 1, second link 102 includes a first end 122 that defines opening 118, and a second end 124. In one embodiment, second end 124 is rigidly connected to third link 104 such that together, second link 102 and third link 104 form a unitary "V-link" configuration. In the embodiment shown, second end 124 of second link 102 is rigidly connected to a first end 126 of third link 104. Third link 104 also includes a second end 128 that defines an opening 130. Additionally, a pin 132 mounted to outer wall 42 extends through openings (not shown) or into a bore (not shown) located at the intersection of second end 124 of second link 102 and first end 126 of third link 104 so that the "V-link" configuration pivots about pin 132.

Fourth link 106, in one embodiment, includes a first end 134 having a retainer portion 136 that extends through opening 130 to retain first end 134 in opening 130 during actuation of linkage mechanism 16, a body 137, and a second end 138 having a retainer portion 140 which is coupled to arm 108 to retain second end 138 in engagement with arm 108 during actuation of linkage mechanism 16.

Controller 18 generally includes a housing 142 in which are housed conventional electronics (not shown) for performing various functions. The electronics may be routed in any suitable manner to various actuation mechanisms (not shown) or other devices for carrying out the various functions. Housing 142 also defines an input surface 144 including a plurality of control switches 146 that permit the patient (or other person) to select one or several of the various functions. It should be understood that one of ordinary skill in the art could readily configure control switches 146 to control any type of function, including bed adjustment functions, television and radio controls, nurse call functions, room environmental controls, etc. Housing 142 also includes a pair of side walls 148, 150, a pair of end walls 152, 154, and a top wall 156 opposite input surface 144. As indicated above, arm 108 is connected to housing 142 of controller 18 such that movement of fourth link 106 results in movement of controller 18 about a pin 109 into and out of recess 34 as is described in detail below. It should be understood, however, that controller 18 need not move into and out of a recess 34, but instead may simply move into and out of a stored position, which may or may not be in direct contact with siderail 12.

FIGS. 2A-B show the basic movement of control panel 10 of FIG. 1. As shown in FIG. 2A, when siderail 12 is in its lowered position, arms 52, 54 (only arm 52 is shown), and center arm 58 extend downwardly from frame 56. In the lowered position, top surface 24 may be supported below an upper surface 160 of a deck 162 for supporting a mattress (not shown). In this manner, siderail 12 is positioned out of the way of caregivers and other personnel who may need unobstructed access to the mattress or a patient supported by deck 162. As shown in FIG. 2A, when siderail 12 is in the lowered position, controller 18 is in its stored position.

When siderail 12 is moved to the raised position as shown in FIG. 2B, linkage assembly 14 pivots outwardly and upwardly relative to frame 56, and may maintain siderail 12 in a substantially perpendicular orientation, as described in detail in the '142 Publication referenced above. This movement of linkage assembly 14 causes actuation of linkage mechanism 16 (as described in greater detail below), which in turn causes controller 18 to move from its stored position to its deployed or use position as shown in FIG. 2B. As is also described in greater detail below, controller 18 remains in its stored position during a portion of the travel of siderail 12 between the lowered position the raised position. In other words, when siderail 12 is being moved toward the raised position, controller 18 does not begin to move out of the stored position until siderail 12 has moved to an intermediate position (i.e., between the lowered position and the raised position) that would permit deployment of controller 18 without risking interference of controller 18 with another structure, such as deck 162. Similarly, when siderail 12 is moved from the raised position to the lowered position, controller 18 moves from its deployed position to its stored position before the movement of siderail 12 places controller 18 in a position of likely interference with another structure, such as deck 162. Again referring to FIG. 2B, when siderail 12 is in the raised position, top side 24 of siderail 12 is positioned well above upper surface 160, and controller 18 extends from siderail 12 in the deployed position. When in the deployed position, controller 18 is supported at an angle from siderail 12 and at an angle and height relative to deck 162 such that a person in the bed can easily reach control switches 146 to actuate selected functions.

Figure 3C:
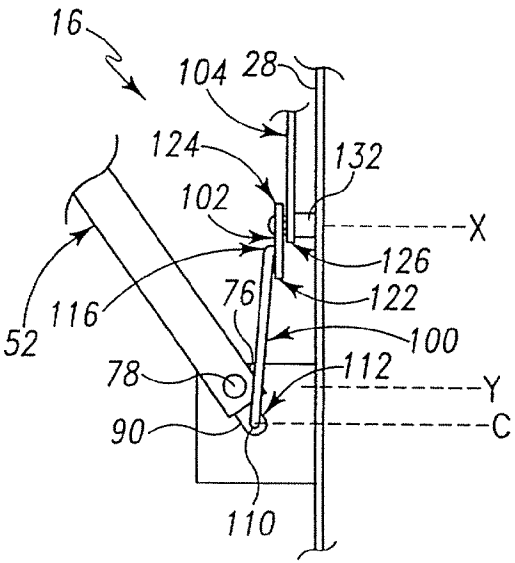
FIGS. 3A-C are partially fragmented, side elevation views of certain components of the embodiment of FIG. 1, showing the siderail in the raised, intermediate, and lowered positions, respectively.
Figure 3B:
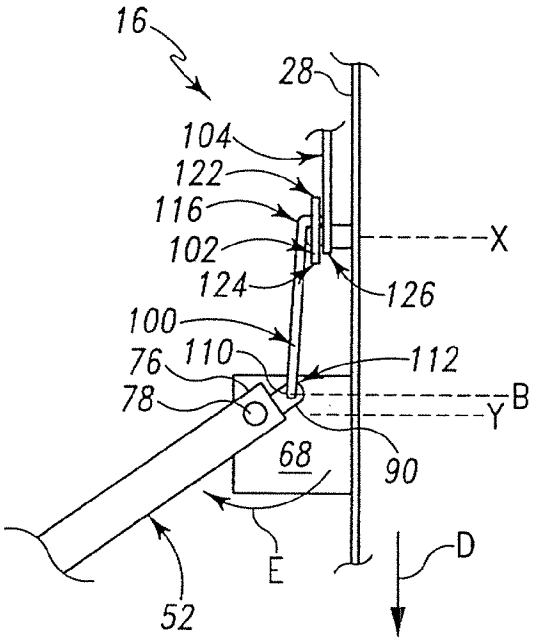
Figure 3A:
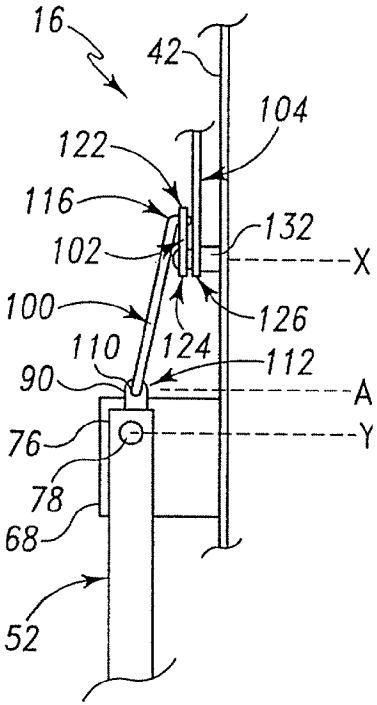
Figure 4A:
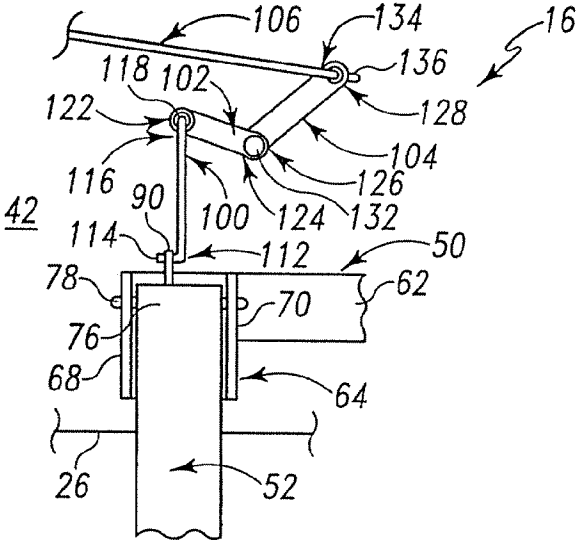
FIGS. 4A-C are partially fragmented, front elevation views corresponding to FIGS. 3A-C, respectively.

Referring now to FIGS. 3A-C and FIGS. 4A-C, the manner in which actuation of linkage assembly 14 to move siderail 12 between the lowered and raised positions causes actuation of linkage mechanism 16 will be described in detail. FIGS. 3A and 4A depict siderail 12 in the raised position. As shown, arm 52 is positioned such that projection 90 extends substantially upwardly, thereby positioning first end 112 of first link 100 at a height A relative to pin 132, which is at height X, and relative to rod 78, which is at height Y. Of course, arm 54 and center arm 58 also support siderail 12, but neither is shown in these figures. As will become apparent from the following description, the distance between pin 132 (height X) and rod 78 (height Y) remains substantially fixed as siderail 12 is moved between the raised position and the lowered position. When siderail 12 is in the raised position shown, second end 116 of first link 100 and first end 122 of second link 102 are in a position above height X.

Figure 4B:
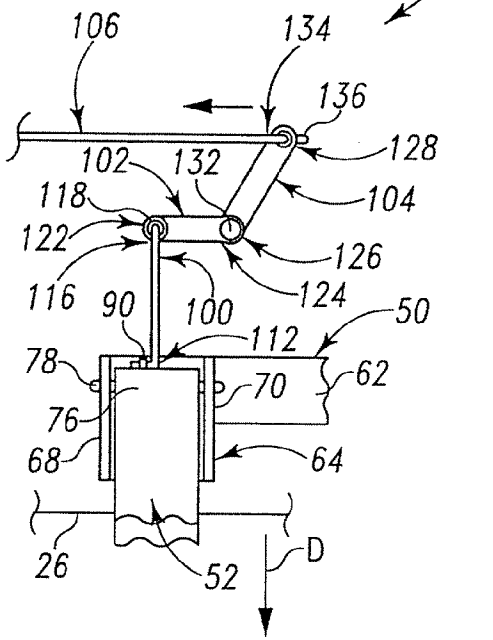

As siderail 12 is moved downwardly as indicated by arrow D in FIGS. 3B and 4B, first end 76 of arm 52 pivots about rod 78 in the direction of arrow E (FIG. 3B). As first end 76 pivots about rod 78, projection 90 also pivots about rod 78, pulling first link 100 downwardly relative to pin 132. When in the intermediate position shown in FIGS. 3B and 4B, first end 112 of first link 100 is at height B. As can be seen by comparing the figures, height B is closer to height Y than height A is to height Y. As is also indicated in the figures, first end 122 of second link 102 is positioned substantially at height X when siderail 12 is in the intermediate position as a result of projection 90 moving from height A to height B. Since second end 124 of second link 102 is rigidly connected to first end 126 of third link 104 at pin 132, movement of first end 122 of second link 102 downwardly causes rotation of second link 102 and third link 104 about pin 132 in a counter-clockwise direction. Consequently, second end 128 of third link 104 moves to the left as is best depicted in FIG. 4B.

Figure 4C:
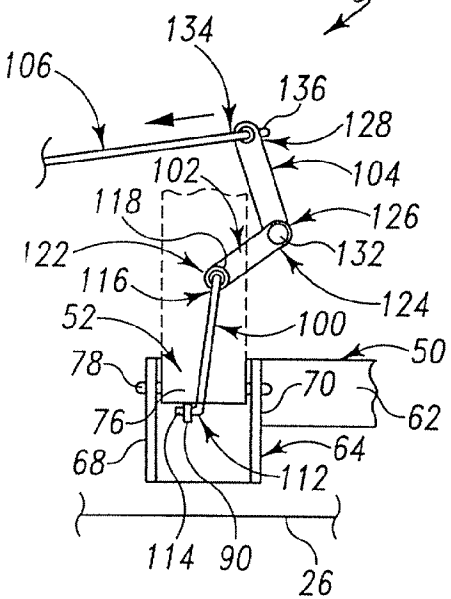

As siderail 12 is moved farther downwardly in the direction of arrow D to the lowered position of FIGS. 3C and 4C, first end 76 of arm 52 pivots farther about rod 78 in the direction of arrow E. When siderail 12 is in the lowered position, projection 90 is positioned below height Y, at height C. This additional downward movement of projection 90 pulls first link 100 farther downwardly, such that second end 116 of first link 100 is below height X (i.e., below pin 132). Consequently, second link 102 and third link 104 pivot farther in a counter-clockwise direction about pin 132. This causes second end 128 of third link 104 to move farther to the left (as viewed in the figures), thereby causing controller 18 to move from its deployed position to its stored position as is described in greater detail below.

Figure 5A:
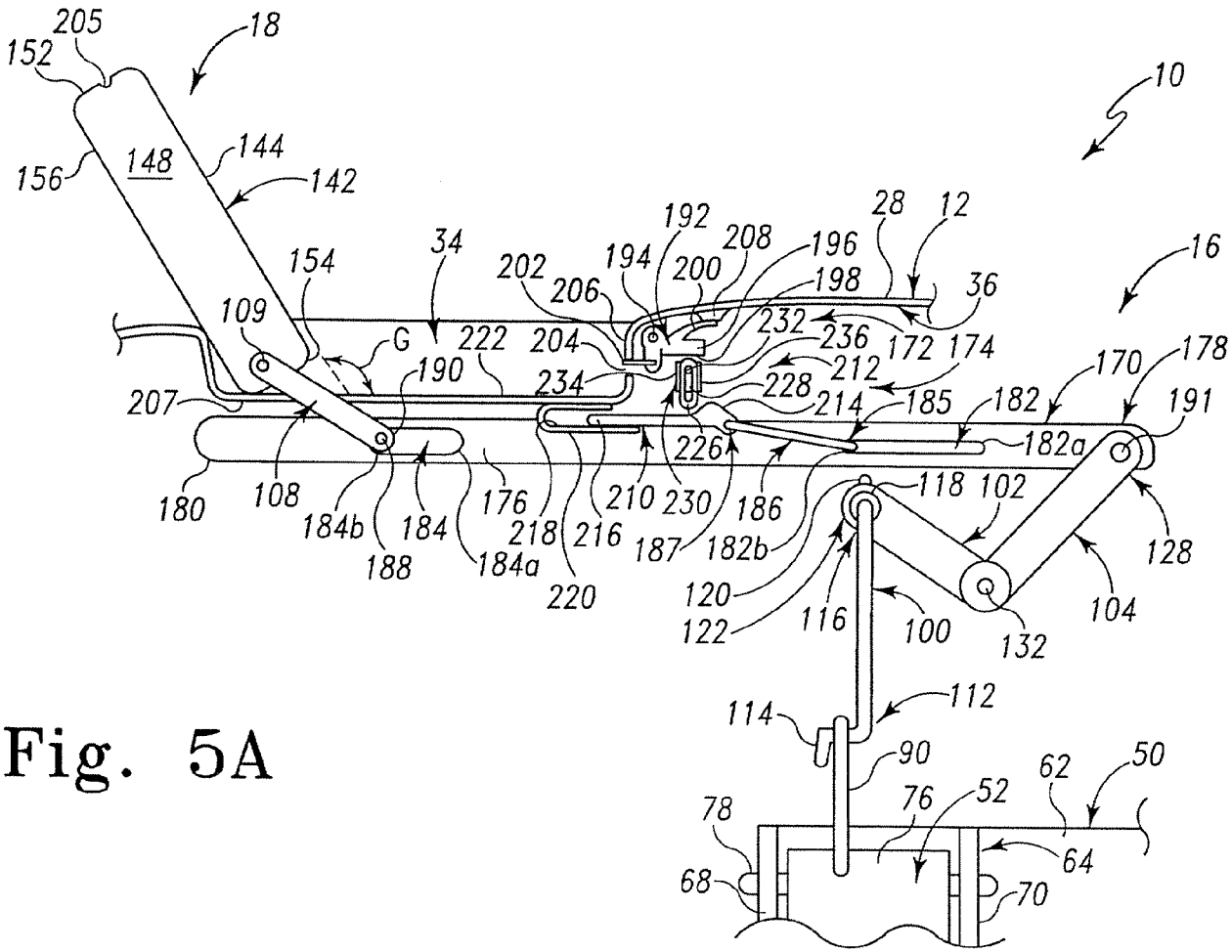
FIGS. 5A-E are partially fragmented, front elevation views of another embodiment of a controller with a siderail, showing the interaction between various components as the siderail is moved between the raised position and the lowered position.

In one embodiment, movement of second end 128 of third link 104 causes controller 18 to move from its deployed position to its stored position as a result of leftward movement of fourth link 106 (depicted in FIG. 1). In this embodiment, leftward movement of fourth link 106 causes second end 138 of fourth link 106 to urge arm 108 toward the left. This, in turn, causes arm 108 and controller 18 to pivot in a clockwise direction about pin 109 (FIG. 5A). As such, controller 18 moves along the arc F (FIG. 1) into recess 34. When siderail 12 is moved from its lowered position to its raised position, the process and movements described above are reversed.

In another embodiment, depicted in FIGS. 5A-E, fourth link 106 is replaced with a different embodiment fourth link 170. Other features, such as a latch 172 and a release mechanism 174 are also shown. Fourth link 170 includes a body 176 having a first end 178 and a second end 180. Body 176 further defines a first slot 182 and a second slot 184. Slot 182 includes a first end 182A and a second end 182B, and is configured to receive a first end 185 of a drive link 186 of release mechanism 174 as is further described below. Similarly, slot 184 includes a first end 184A and a second end 184B, and is configured to receive a pin 188, which is connected to a first end 190 of arm 108. First end 178 of fourth link 170 is connected to end 128 of third link 104 by a pin 191.

Latch 172 generally includes a body 192 which is pivotally connected by a pin 194 to outer shell 36 of siderail 12 adjacent mattress side 28. Body 192 includes a lever arm 196 having an engagement surface 198, a spring arm 200, and a tab 202. When in a latched position as shown, for example, in FIG. 5A, tab 202 extends through an opening 204 formed in a side wall 206 of recess 34, and is configured to engage a notch 205 formed in end wall 152 of controller 18 as is further described below. Additionally, spring arm 200 is positioned adjacent an engagement surface 208 on an interior side of shell 36.

Release mechanism 174 generally includes drive link 186 (mentioned above), a release body 210, and an actuator 212 positioned below engagement surface 198 of lever arm 196. Release body 210 includes a cam surface 214 configured to engage actuator 212 as described below, and a finger 216. Finger 216 is sized to fit within a channel 218 formed by a support 220 connected to or integral with a lower wall 222 of recess 34. A second end 187 of drive link 186 is connected to release body 210 as shown in the figures.

Actuator 212 includes a body 226 having a central slot 228, and a bracket 230 connected to an interior surface of outer shell 36. Slot 228 of body 226 is formed to receive a pin 232 extending from bracket 230. Pin 232 is configured, on the other hand, to retain body 226 on bracket 230, but to permit upward and downward movement of body 226. Bracket 230 includes a pair of flanges 234, 236 which extend substantially perpendicularly away from the interior surface of shell 36 to guide body 226 through its upward movement into engagement with engagement surface 198 of lever arm 196 and its downward movement out of engagement with engagement surface 198, as is further described below. Of course, various other configurations are possible for actuator 212. For example, body 226 may include a pin or pins that move within a slot or slots formed in bracket 230. Any configuration is suitable so long as body 226 is movable (as a result of contact with release body 210) into and out of engagement with engagement surface 198 of latch body 192.

As shown in FIG. 5A, when siderail 12 is in the raised position, linkage mechanism 16 is in substantially the same position as shown in FIGS. 3A and 4A. In this position, first end 190 of arm 108 is adjacent end 184B of slot 184. Arm 108 extends through a slot 207 formed in lower wall 222 and side wall 206 of recess 34. Additionally, first end 185 of drive link 186 is adjacent end 182B of slot 182. As will become apparent from the following description, the relative position of first end 190 of arm 108 to slot 184, and the relative position of first end 185 of drive link 186 to slot 182 changes with movement of linkage mechanism 16 as siderail 12 is moved between the lowered position to the raised position. As shown in the figure, controller 18 is in the deployed position, wherein control switches 146 (FIG. 1) are relatively easily accessible by a user. When in the deployed position, input surface 144 of controller 18 forms an angle G relative to lower wall 222 of recess 34. In one embodiment, angle G is approximately 115 degrees.

Figure 5B:
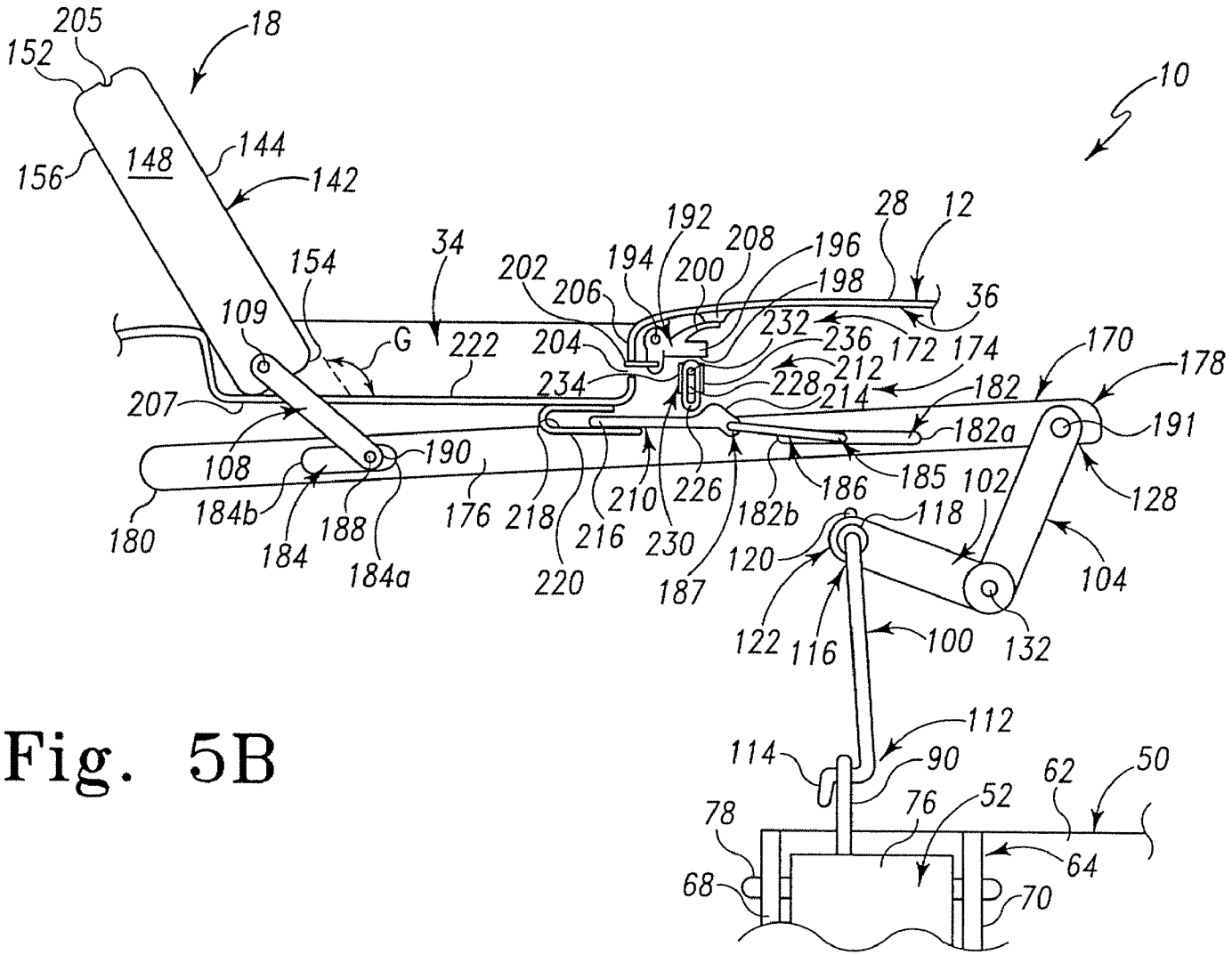
Figure 5C:
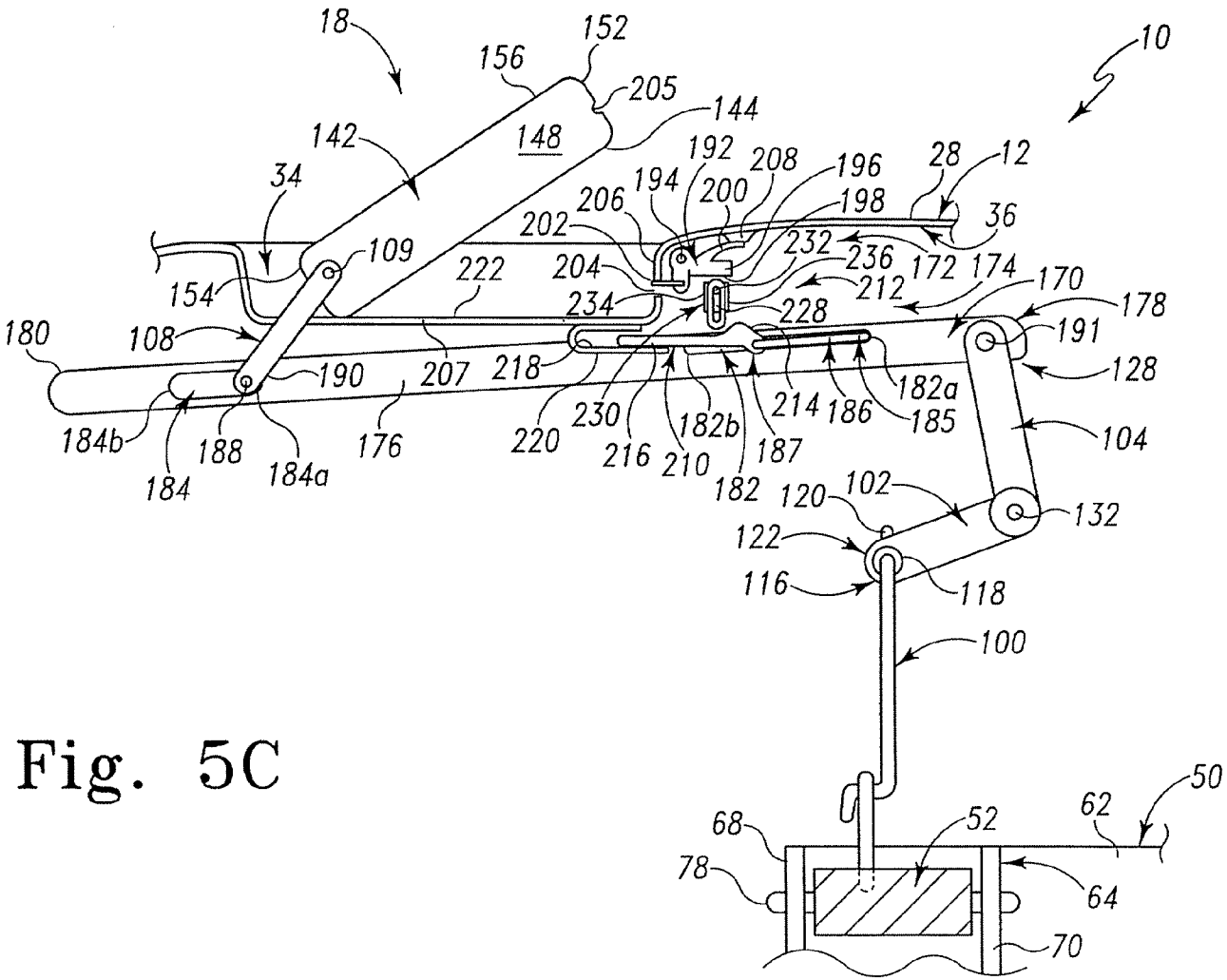
Figure 5D:
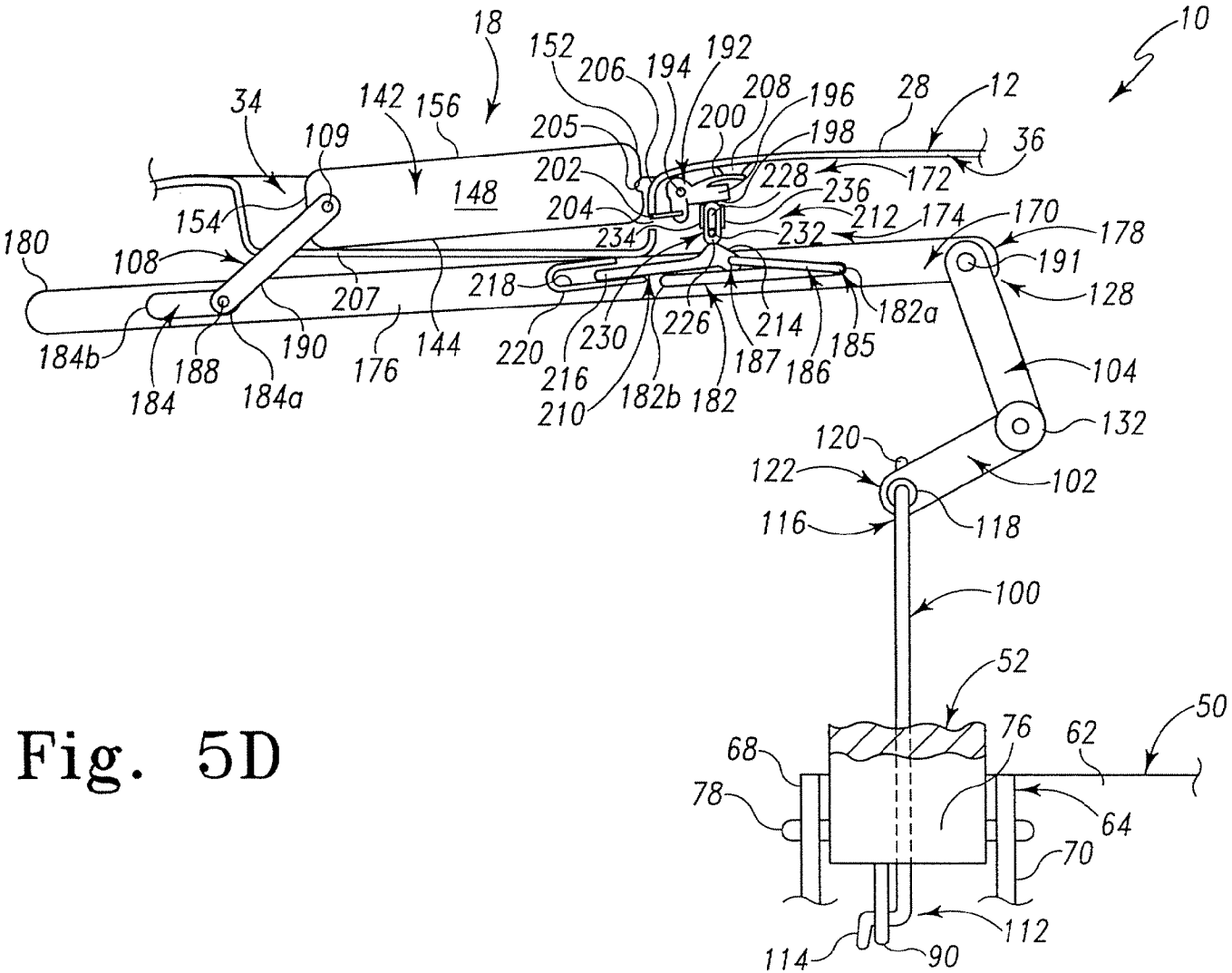
Figure 5E:
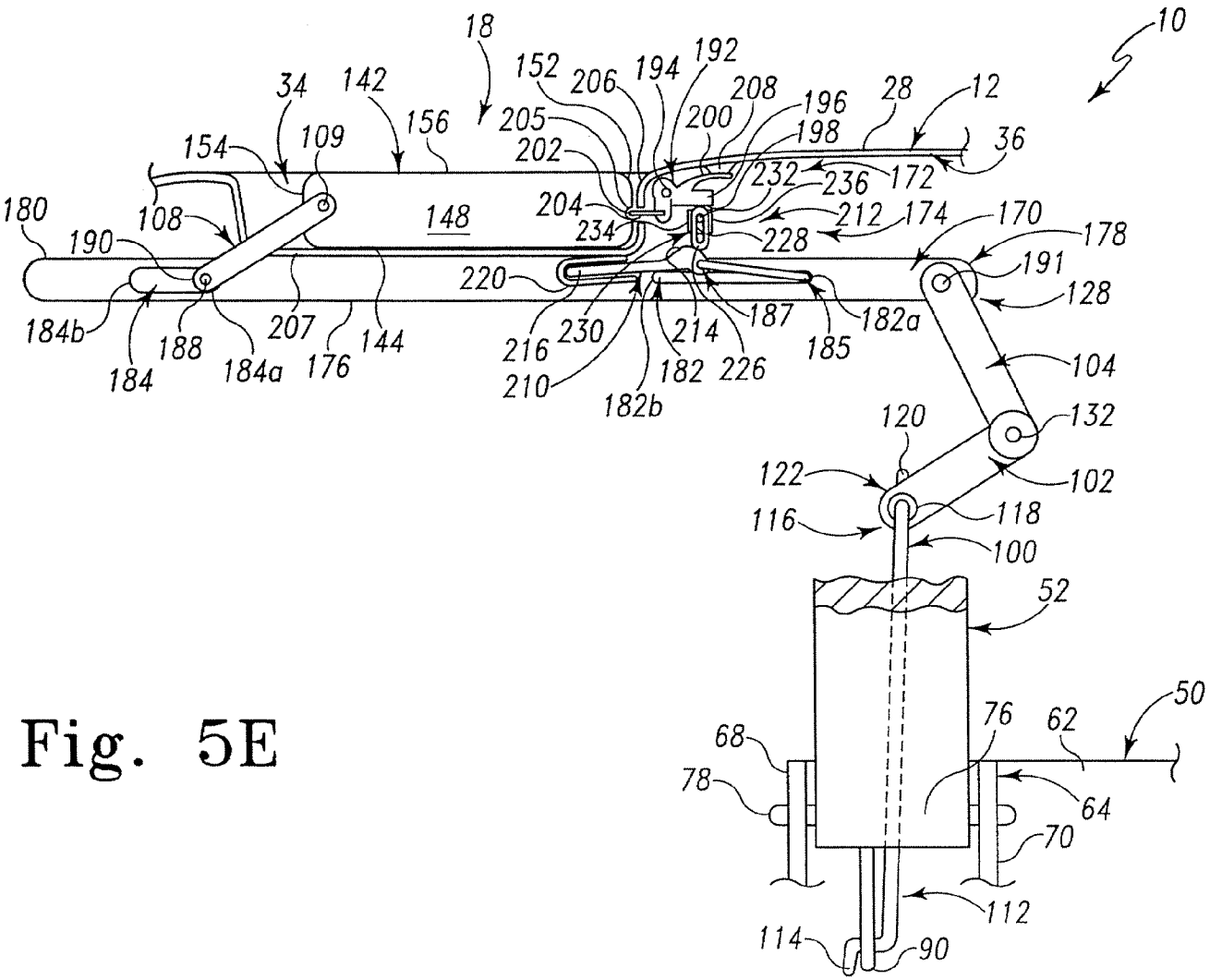

Referring now to FIG. 5B, siderail 12 is shown in a first intermediate position between the raised position of FIG. 5A and the lowered position of FIG. 5E. In this intermediate position, siderail 12 has just begun to be lowered from the raised position. As siderail 12 is lowered, arm 52 of linkage assembly 14 pivots about rod 78, thereby moving projection 90 downwardly relative to pin 132 (which is at height X), as explained above with reference to FIGS. 3A-C and 4A-C. Consequently, first link 100 moves downwardly, the combination of second link 102 and third link 104 pivot in a counter-clockwise direction about pin 132, and fourth link 170 moves to the left as viewed in the figures. As shown in FIG. 5B, as a result of this leftward movement, first end 190 of arm 108 is now adjacent end 184A of slot 184 and first end 185 of drive link 186 is now in between ends 182A and 182B of slot 182. Controller 18 has not yet moved from its deployed position. Thus, during this first part of downward movement of siderail 12 (and the corresponding movement of linkage mechanism 16), controller 18 may remain deployed.

FIG. 5C shows siderail 12 at a second intermediate position between the raised position and the lowered position. As shown, arm 52 (now extending directly out of the page) has pivoted farther about rod 78, thereby moving projection 90 and first link 100 (not shown in FIG. 5C) farther downwardly relative to pin 132. Again, this downward movement causes counter-clockwise rotation of second link 102 and third link 104 about pin 132, and leftward movement of fourth link 170. The additional leftward movement (relative to FIG. 5B) of fourth link 170 causes arm 108 and controller 18 to pivot about pin 109. More specifically, first end 190 of arm 108 engages end 184A of slot 184 and is urged toward the left. Since, in this embodiment, arm 108 is rigidly connected to housing 142 of controller 18, and since housing 142 is pivotally supported on siderail 12 by pin 109, leftward movement of first end 190 of arm 108 causes clockwise rotation of arm 108 and controller 18 about pin 109. As is also shown in FIG. 5C, fourth link 170 has now moved sufficiently to the left that first end 185 of drive link 186 is adjacent end 182A of slot 182.

FIG. 5D shows a third intermediate position of siderail 10. As shown, arm 52 of linkage assembly 14 has rotated farther about rod 78, and projection 90 is now positioned below rod 78. Consequently, first link 100 has been pulled farther downwardly, and second link 102 and third link 104 have rotated farther about pin 132 in a counter-clockwise direction. As a result, fourth link 170 is positioned farther to the left (relative to FIG. 5C). This leftward movement of fourth link 170 causes controller 18 to pivot farther about pin 109 as end 184A of slot 184 drives first end 190 of arm 108 farther to the left. As shown, controller 18 is very nearly in its stored position. In this embodiment, the relative positions of end 184A of slot 184 and end 182A of slot 182 ensure that controller 18 will pivot almost all the way into the stored position before latch 172 is actuated. As shown in FIG. 5D, the leftward movement of fourth link 170 from the position of FIG. 5C to the position of FIG. 5D causes end 182A of slot 182 to drive first end 185 of drive link 186 to the left. This, in turn, urges release body 210 to the left such that cam surface 214 moves under and engages actuator body 226. Finger 216 of release body 210 also moves partially into channel 218 defined by support 220. As cam surface 214 moves under and engages actuator body 226, actuator body 226 is urged upwardly. Thus, actuator body 226 travels upwardly within the channel defined by flanges 234, 236 and pin 232 shifts position relative to slot 228.

FIG. 5D shows actuator body 226 near the top of its travel within bracket 230, wherein the upper surface of body 226 has engaged engagement surface 198 of lever arm 196 and urged latch 172 to its unlatched position. More specifically, lever arm 196 is urged upwardly against the biasing force of spring arm 200, which is also engaged by engagement surface 208 of shell 36. As lever arm 196 is urged upwardly, body 192 of latch 172 pivots in a counter-clockwise direction about pin 194. This counter-clockwise pivoting causes tab 202 of latch 172 to retract from opening 204 into the interior of siderail 12. Thus, as siderail 12 is moved farther downwardly into its lowered position, and controller 18 pivots farther clockwise into its stored position, tab 202 will be retracted to avoid interference with end wall 152 of controller housing 142.

FIG. 5E shows siderail 12 in its lowered position and controller 18 in its stored position. As a result of additional downward movement of siderail 12, arm 52 has pivoted to its fullest extent about pin 78, thereby moving projection 90 to its lowermost position (i.e., height C as shown in FIG. 3C). As such, first link 100 is at its lowest position, and second link 102 and third link 104 are at a position corresponding to their maximum counter-clockwise rotation about pin 132. As shown in the figure, fourth link 170 has also moved farther to the left (relative to its position in FIG. 5D) as a result of the rotation of second link 102 and third link 104. This leftward movement has caused first end 184A of slot 184 to urge first end 190 of arm 108 farther to the left, thereby causing arm 108 and controller 18 to pivot farther clockwise about pin 109 until controller 18 reaches its stored position as shown in FIG. 5E. At approximately the same time as controller 18 reaches its stored position, the leftward movement of fourth link 170 causes first end 182A of slot 182 to urge drive link 186 (and release body 210) to the left so that cam surface 214 of release body 210 moves out of engagement with actuator body 226. When release body 210 moves out of engagement with actuator body 226 into the position shown in FIG. 5E, actuator body 226 moves downwardly under the force of gravity and the biasing force of spring arm 200 of latch 172. This permits movement of spring arm 200 into its non-compressed position, which causes latch body 192 to rotate in a clockwise direction about pin 194. Consequently, tab 202 of latch 172 moves back through opening 204 of side wall 206, and into notch 205 of controller 18. The engagement of tab 202 and notch 205 retains or locks controller 18 in its stored position.

It should be understood from the foregoing that one of ordinary skill in the art could readily adjust the timing of the various movements of the components of control panel 10 by adjusting the relative positions of certain components and/or the size and/or shape of certain components. For example, the delay before controller 18 begins to move toward its stored position as siderail 12 is moved out of its raised position can be changed by adjusting, for example, the length and/or position of slot 184. The timing of actuation of latch 172 may be changed by adjusting, for example, the length and/or position of slot 182. The relative timing of movement of controller 18 into its stored position and movement of latch 172 from its latched to its unlatched position may be changed by adjusting, for example, the relative locations of end 184A of slot 184 and end 182A of slot 182. Any of a variety of other adjustments are within the scope of this disclosure and the ability of a skilled artisan.

The interaction among the components of control panel 10 of FIGS. 5A-E during movement of siderail 12 from the lowered position to the raised position is substantially the reverse of the interactions described above. Accordingly, a more abbreviated description will follow. As siderail 12 is moved upwardly out of the lowered position of FIG. 5E, the movements of arm 52, first link 100, second link 102, and third link 104 cause fourth link 170 to move to the right as viewed in the figures. The first portion of this rightward movement (i.e., during the movement of siderail 10 out of potential interference with, for example, deck 162 as shown in FIG. 2A) does not result in movement of either latch 172 or controller 18 since drive link 186 and arm 108 move freely within slot 182 and slot 184, respectively.

Eventually, fourth link 170 moves sufficiently to the right that first end 185 of drive link 186 engages end 182B of slot 182, and release body 210 (specifically, cam surface 214) is pulled under actuator 212. This causes actuator body 226 to move upwardly into engagement with engagement surface 198 of latch 172. Latch 172 then rotates counter-clockwise against the biasing force of spring arm 200, retracting tab 202 from notch 205 of controller 18.

At this point in the upward movement of siderail 12 (a point roughly corresponding to FIG. 5D), fourth link 170 has moved sufficiently to the right that first end 190 of arm 108 engages end 184B of slot 184 and is pulled to the right, causing arm 108 and controller 18 to pivot in a counter-clockwise direction about pin 109.

When release body 210 is pulled fully to the right of actuator 212, actuator body 226 moves down and latch 172 pivots in a clockwise direction to its latched position as shown in FIG. 5C. Additional upward movement of siderail 12 (and corresponding rightward movement of fourth link 170) results in movement of release body 210 farther to the right of actuator 212 and farther counter-clockwise pivoting of controller 18 about pin 109 until it reaches its deployed position shown in FIG. 5A. As should be apparent from the foregoing, controller 18 reaches its deployed position at approximately the same time that siderail 12 reaches its raised position.

Figure 6A:
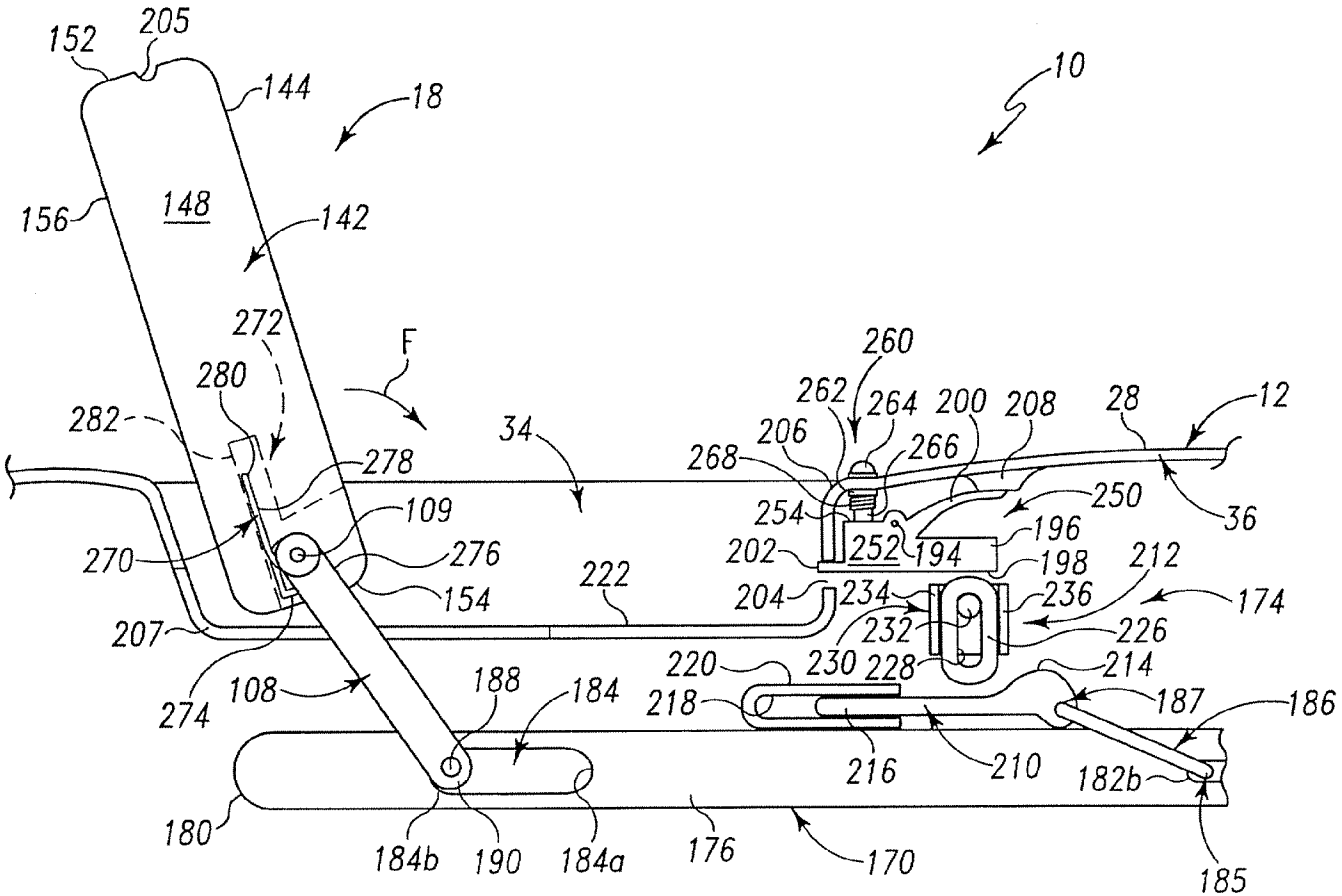
FIG. 6A is a partially fragmented, front elevation view of another embodiment of a controller with a siderail, showing the siderail in the raised position and the controller in the deployed position.
Figure 6B:
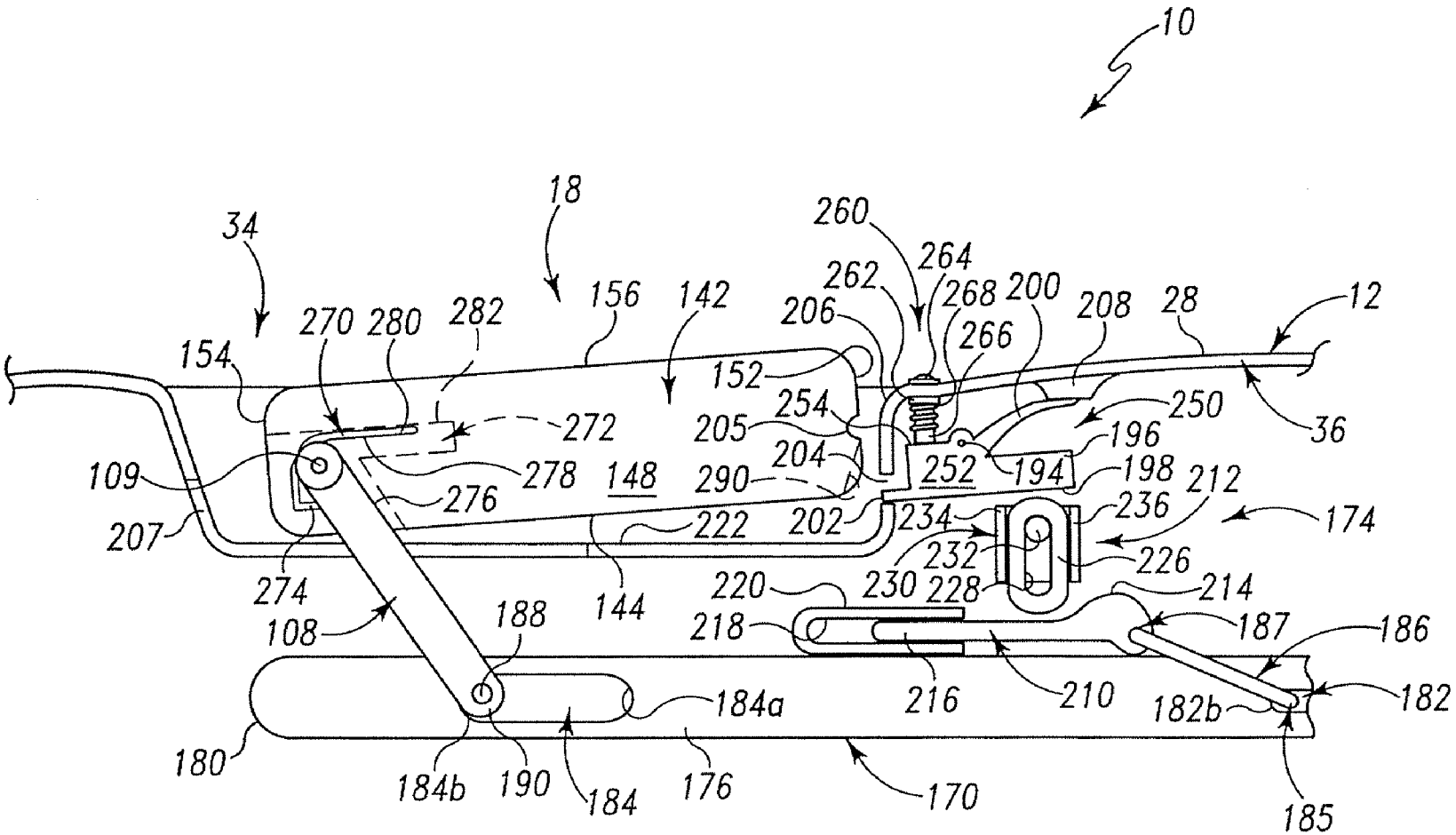
FIG. 6B is a partially fragmented, front elevation view of the embodiment of FIG. 6A with the controller approaching the stored position.

FIGS. 6A-B depict yet another embodiment of a control panel 10. In this embodiment, siderail 12 is configured to permit movement of controller 18 between the stored and deployed positions while siderail 12 remains in the raised position. In some instances, it may be desirable to permit manual movement of controller 18 to its stored position while siderail 12 is raised to, for example, permit easier access to a patient in a bed, or to permit deployment of only one of two controller 18 in a bed equipped with two control panels 10. Of course, if controller 18 is manually moved to its stored position while siderail 12 is in its raised position, it may also be desirable to permit manual movement of controller 18 out of its stored position, and back into its deployed position while siderail 12 remains in its raised position. The embodiment of FIGS. 6A-B provides these features.

The embodiment of FIGS. 6A-B is substantially similar to the embodiment of FIGS. 5A-E, except that latch 172 is reconfigured as latch 250, a manual release 260 is added, and the connection between arm 108 and controller 18 is reconfigured. Accordingly, common components will not be described, and will retain their original reference designations. Latch 250 is substantially the same as latch 172, except that unlike body 192, body 252 is shaped to include a second engagement surface 254 on an upper portion of body 252 as viewed in the figures. It should be noted that second engagement surface 254, unlike engagement surface 198, is on the left side of pin 194 in this embodiment.

Manual release 260 includes a housing 262 mounted within an opening (not shown) in shell 36 of siderail 12, a button 264 movably mounted within housing 262, a shaft 266 connected to or integral with button 264, and a spring 268 connected between housing 262 and shaft 266. When manual release 260 is in its retracted position as shown in FIG. 6A, spring 268, which is connected at one end (not shown) to housing 262 and at the other end (not shown) to shaft 266, is in a substantially unextended state. Thus, spring 268 may retain shaft 266 just above, or in slight contact with engagement surface 254 of body 252.

The connection between arm 108 and controller 18 in the embodiment of FIGS. 6A-B is a movable connection, unlike the rigid connection of the embodiment of FIGS. 5A-E. More specifically, controller 18 is permitted to rotate about pin 109 while arm 108 remains in a fixed position relative to pin 109. To this end, a spring 270 is disposed within a cavity 272 formed in housing 142 of controller 18. Spring 270 includes a first end 274 that is attached to a second end 276 of arm 108 (and/or to pin 109), a body 278 that may coil around pin 109, and a second end 280 that is biased against a back wall 282 of cavity 272. Thus, spring 270 biases controller 18 toward its deployed position.

If, when siderail 12 is in its raised position, a user wishes to move controller 18 to its stored position, the user may simply push top wall 156 of housing 142 to pivot controller 18 in direction F toward its stored position. During this pivoting about pin 109, arm 108 remains in a fixed position, and controller 18 moves relative to arm 108 against the biasing force of spring 270 applied to back wall 282 of cavity 272. As controller 18 approaches the stored position, the user may activate manual release 260 as depicted in FIG. 6B. When the user presses button 264 downwardly, shaft 266 is extended downwardly against the biasing force of spring 268, which extends. Shaft 266 engages second engagement surface 254 of body 252, causing counter-clockwise rotation of body 252 about pin 194 against the biasing force of spring arm 200. This counter-clockwise rotation causes tab 202 to retract through opening 204 in side wall 206 of recess 34. When controller 18 is pushed into its stored position, button 264 of manual release 260 may be released. When button 264 is released, shaft 266 is moved back to its retracted position as spring 268 retracts to its unextended state, and spring arm 200 causes body 252 to rotate in a clockwise direction about pin 194. This clockwise rotation causes tab 202 to move back through opening 204 and into notch 205 of controller 18, thereby retaining controller 18 in its stored position.

It should be understood that instead of requiring the user to actuate manual release 260 in the manner described above to manually facilitate retention of controller 18 in its stored position, end wall 152 of controller housing 142 may be formed to include an inclined cam surface 290 (as indicated in dotted lines in FIG. 6B). In such an embodiment, as controller 18 approaches its stored position, cam surface 290 of end wall 152 engages tab 202, and urges tab 202 into opening 204, thereby causing counter-clockwise rotation of body 252 about pin 194 against the biasing force of spring arm 200. When controller 18 reaches its stored position in this embodiment, tab 202 aligns with notch 205, and the biasing force of spring arm 200 causes clockwise rotation of body 252 (including tab 202), thereby causing tab 202 to snap into notch 205 and retain controller 18 in the stored position.

In either of the two previously described embodiments, the user may re-deploy controller 18 by actuating manual release 260. More specifically, the user may press button 264 downwardly, thereby causing shaft 266 to engage second engagement surface 254 in the manner described above. Additional downward movement of button 264 causes counter-clockwise rotation of body 252 about pin 194 against the biasing force of spring arm 200. This also causes tab 202 to retract from notch 205. When tab 202 is retracted from notch 205, spring 270 is free to return to its initial position (as shown in FIG. 6A), thereby moving controller 18 back to its deployed position.

It should also be understood that the latching and unlatching functions of latch 250 and release mechanism 174 as a result of movement of siderail 12 still occur in the embodiments of FIGS. 6A-B. More specifically, if controller 18 is manually placed in its stored position while siderail 12 is in its raised position, and siderail 12 is then moved to its lowered position, controller 18 will remain substantially in its stored position. Release mechanism 174 may cause temporary movement of tab 202 of latch 250 out of notch 205 as cam surface 214 is moved under actuator body 212, but, as shown in FIG. 5D, controller 18 is substantially in its stored position when such action occurs. Also, as shown in FIG. 5E, tab 202 will return to notch 205 when siderail 12 reaches its lowered position.

Figure 7:
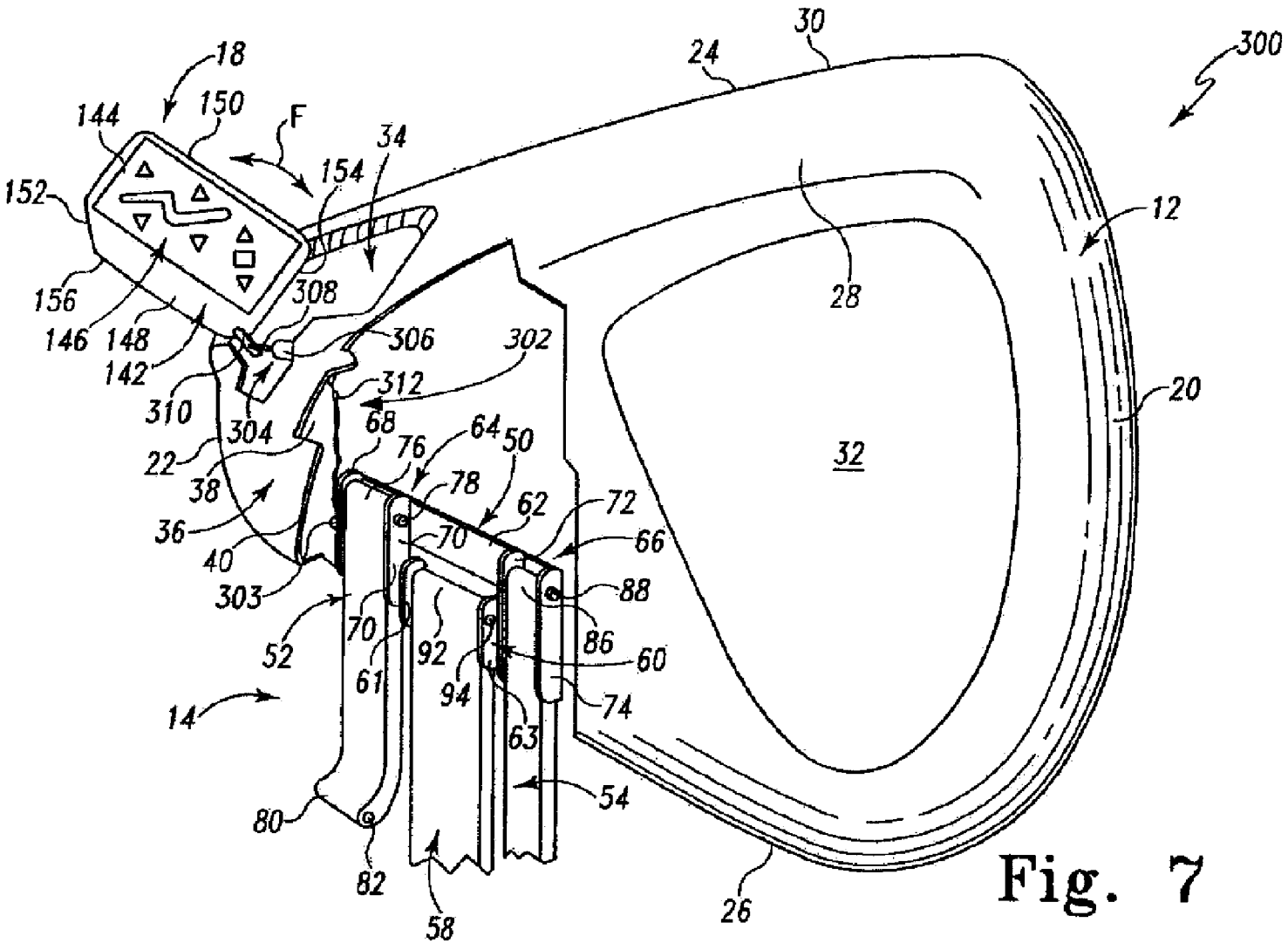
FIG. 7 is a partially fragmented, perspective view of another embodiment of a controller with a siderail in the raised position.

FIG. 7 shows yet another embodiment of a control panel. Control panel 300 of FIG. 7 is substantially similar to control panel 10 of FIG. 1, except that linkage mechanism 16 is replaced by an electronic drive mechanism 302. Common components between the two embodiments have retained the same reference designations.

Electronic drive mechanism 302 generally includes a sensor 303 and a motor assembly 304. Sensor 303 is mounted, for example, to flange 68 of end portion 64, and is configured to detect movement of arm 52 as arm 52 pivots about rod 78 in the manner described above. Sensor 303 may use any of a variety of different conventional sensor technologies, including magnetic, optic, capacitive, resistive, or other suitable technologies. It should be understood that arm 52 may also include a component for detection by sensor 303. Such a component would be coupled to arm 52 in a suitable location such that when arm 52 pivots past one or more particular angular positions relative to rod 78, sensor 303 detects the component coupled to arm 52. As will become apparent from the following description, sensor 303 may be mounted in any of a variety of locations to sense the position of components other than arm 52, so long as sensor 303 is able to detect when siderail 12 is in one or more desired positions.

Motor assembly 304 includes a motor 306 that may be mounted to shell 36 of siderail 12, and a shaft 308 coupled to motor 306. Motor 306 may be any of a variety of conventional motor types. Motor 306 and shaft 308 are configured such that when motor 306 is activated in the manner described below, motor 306 causes shaft 308 to move either along or about a longitudinal axis of shaft 308. As shown in FIG. 7, the free end of shaft 308 is coupled to an arm 310, which is coupled to housing 142 of controller 18. Arm 310 may be substantially identical to the embodiments of arm 108 described above, except for its connection to shaft 308, as is further described below. Finally, as is also indicated in FIG. 7, motor 306 is connected to sensor 303 by conductors 312. It should be understood, however, that conductors 312 may be optional if sensor 303 and motor 306 are configured such that sensor 303 can wirelessly communicate a signal to motor 306 when arm 52 moves past one or more particular positions. Electronic drive mechanism 302 may (or may not) use the same power source (not shown) as controller 18.

In use, when siderail 12 is moved out of the raised position shown in FIG. 7, arm 52 pivots about rod 78 in the manner described above. As arm 52 pivots past a first position, sensor 303 detects arm 52 and provides a signal to motor 306. Motor 306 is thus activated, and begins rotating shaft 308 about its longitudinal axis, or extending shaft 308 outwardly from motor 306 along its longitudinal axis, depending upon the configuration of motor assembly 304. If shaft 308 is configured to rotate, then the connection between shaft 308 and arm 310 is configured to convert the rotation of shaft 308 into linear movement of the end of arm 310 to the left as viewed in FIG. 7. If shaft 308 is configured to extend outwardly from motor 306 along its longitudinal axis (i.e., to the left as viewed in FIG. 7), then the connection between shaft 308 and arm 310 is configured such that the end of arm 310 also moves to the left. In either case, the leftward movement of the end of arm 310 causes controller 18 to pivot toward the stored position in the manner described above.

It should be understood that the first position of arm 52 at which motor 306 is activated is a sufficiently upward position to permit motor assembly 304 to drive controller 18 into the stored position before controller 18 would interfere with structure such as deck 162 (FIGS. 2A-B) during further movement of siderail 12 toward the lowered position. It should also be understood that the speed at which motor assembly 304 drives controller 18 into the stored position also influences the desired location of the first position of arm 52. In other words, if motor assembly 304 drives controller 18 relatively slowly, then the first position of arm 52 (i.e., the position at which movement of arm 52 causes actuation of motor 306) should be relatively close to the position shown in FIG. 7. If, on the other hand, motor assembly 304 drives controller 18 relatively quickly, then the first position of arm 52 may be closer to, for example, the intermediate position shown in FIG. 3B. Finally, it should be understood that a variety of conventional techniques may be employed to disable or deactivate motor 306 when controller 18 reaches the stored position. For example, another sensor may be mounted at an appropriate location within recess 34 to detect movement of controller 18 into the stored position, and send a signal to motor 306 to deactivate motor 306. Alternatively, motor 306 may be configured to sense resistance to movement of shaft 308 (indicating that controller 18 has engaged lower wall 222 of recess 34), and automatically deactivate. Other suitable techniques may also be employed.

When siderail 12 is in the lowered position such as the position shown in FIG. 3C, arm 52 is positioned substantially downwardly, and controller 18 is in the stored position. When siderail 12 is raised from the lowered position, arm 52 pivots relative to rod 78 in the manner described above. When arm 52 pivots past a second position, such as the intermediate position shown in FIG. 3B, sensor 303 detects arm 52 and sends a signal to motor 306 to activate motor 306. Motor 306 then causes rotation or linear movement of shaft 308 to drive the end of arm 310 to the right (as viewed in the figures). As arm 310 moves to the right, controller 18 pivots toward the deployed position as described above. When siderail 12 reaches the raised position as shown in FIG. 7, controller 18 is in the deployed position.

As mentioned above with reference to movement of controller 18 to the stored position, the location of the second position of arm 52 and the speed of motor assembly 304 are such that motor assembly 304 drives controller 18 toward the deployed position only after siderail 12 has been moved sufficiently upwardly that interference between controller 18 and other structure, such as deck 162, is avoided. Deactivation of motor 306 after controller 18 reaches the deployed position may be accomplished in the manner described above.

As should be apparent from the foregoing, the first and second positions of arm 52 may be the same position. For example, the first and second positions may correspond to the position of arm 52 when siderail 12 is in the raised position. As such, when arm 52 moves out of this upward position (indicating movement of siderail 12 toward the lowered position), sensor 303 may activate motor 306 to move controller 18 to the stored position. When arm 52 moves into this upward position (indicating that siderail 12 has been moved into the raised position), sensor 303 may activate motor 306 to move controller 18 to the deployed position. Of course, the first and second positions of arm 52 may alternatively be separate positions.

As should also be apparent from the foregoing, arm 310 may be configured to attach to housing 142 in the manner described with reference to FIGS. 6A-B, thereby permitting manual movement of controller 18 into and out of the stored position when siderail 12 is in the raised position.

The foregoing description of the device is illustrative only, and is not intended to limit the scope of protection of the device to the precise terms set forth. Although the device has been described in detail with reference to certain illustrative embodiments, variations and modifications exist within the scope and spirit of the device as described and defined in the following claims.

What is claimed is:

1. A controller for use with a patient support including a siderail having a lowered position and a raised position, comprising:

a housing including at least one selector to select a controllable function; and a linkage mechanism coupled to the housing, the linkage mechanism being adapted to respond to movement of the siderail from the lowered position to the raised position and to correspondingly move the housing from a stored position to a deployed position spaced from the stored position.

2. The controller of claim 1, wherein the housing is pivotably mounted to a patient side of the siderail.

3. The controller of claim 1, wherein the at least one selector is adapted to select a bed adjustment function.

4. The controller of claim 1, wherein the at least one selector is adapted to select a nurse call function.

5. The controller of claim 1, wherein the siderail includes a recess defined to receive at least a portion of the housing.

6. The controller of claim 5, wherein the recess defines the stored position of the housing.

7. The controller of claim 1, wherein the stored position is located adjacent the siderail.

8. The controller of claim 1, wherein the deployed position is spaced from the siderail.

9. The controller of claim 1, wherein the patient support includes a frame and an arm extending between the frame and the siderail, wherein movement of the arm moves the housing from the stored position to the deployed position.

10. The controller of claim 9, wherein the linkage mechanism includes a first link having a first end, the first end being coupled to the arm wherein movement of the arm moves the link.

11. The controller of claim 1, wherein the housing includes a plurality of selectors each to select a different controllable function.

12. The controller of claim 1, wherein the deployed position comprises a fixed position.

13. The controller of claim 12, further comprising a release to enable movement of the controller from the deployed position to the storage position when the siderail is in the raised position.

14. The controller of claim 13, wherein the release is located at the siderail.

15. A control device for use with a patient support including a siderail having at least two positions, comprising:

a linkage mechanism, having a first position associated with one of the at least two positions and a second position associated with another of the at least two positions;

a housing, coupled to the linkage mechanism, the first position of the linkage mechanism locating the housing at a storage position and the second position of the linkage mechanism locating the housing at a deployed position; and a release to enable movement of the control device from the deployed position to the storage position when the siderail is in one of the at least two positions.

16. The control device of claim 15, wherein the housing includes at least one selector to select a controllable function.

17. The control device of claim 16, wherein the at least two positions include a raised position and a lowered position.

18. The control device of claim 17, wherein the release enables movement of the control device from the deployed position to the storage position when the siderail is in the raised position.

19. The control device of claim 15, wherein the release includes a release selector located at the siderail.

20. The control device of claim 15, wherein the housing includes a notch and the release includes a tab, wherein the notch and the tab cooperate to retain the housing at the storage position.

* * * * *